United States Patent [19]

Humitz et al.

[11] Patent Number: 4,978,014

[45] Date of Patent: Dec. 18, 1990

[54] RAIL CAR SHIPPING RACK HAVING YIELDING RACK EXTENSION MEMBERS

[75] Inventors: John N. Humitz, Dearborn; Robert W. Potter, Trenton; Kenneth J. Kostrzewa, Clarkston, all of Mich.

[73] Assignee: Chrysler Corporation, Highland Park, Mich.

[21] Appl. No.: 396,188

[22] Filed: Aug. 21, 1989

[51] Int. Cl.[5] ..... A47F 5/00

[52] U.S. Cl. ..... 211/195; 108/54.1; 211/175; 16/284

[58] Field of Search ..... 211/195, 41, 194, 175; 16/284; 206/454, 448; 248/417, 289.3; 108/54.1, 55.1, 53.1, 56.1

[56] References Cited

U.S. PATENT DOCUMENTS

| | | | |
|---|---|---|---|
| 700,694 | 5/1902 | LeMarr | 16/284 |
| 996,413 | 6/1911 | Katzenberger | 16/284 |
| 1,386,621 | 8/1921 | Hughes | 248/417 X |
| 4,537,421 | 8/1985 | Teachout | 211/195 X |
| 4,692,963 | 9/1987 | Barroero | 16/284 X |
| 4,699,280 | 10/1987 | Hoss | 211/195 |
| 4,874,098 | 10/1989 | Moulds | 211/41 X |

*Primary Examiner*—Robert W. Gibson, Jr.
*Attorney, Agent, or Firm*—Edward A. Craig

[57] ABSTRACT

A shipping rack which is convertible to a first rack length for snug lengthwise loading across the interior width of a semi-trailer and convertible to a second rack length for snug loading lengthwise across the interior width of a railroad boxcar. Pivotal rack extensions are provided on one end wall which will yield to potentially damaging forces and then self center. The rack extensions are held in a first position folded into the end wall to form the first rack length and are pivotal out of the end wall and are self positioning in a second position to form a second rack length.

3 Claims, 3 Drawing Sheets

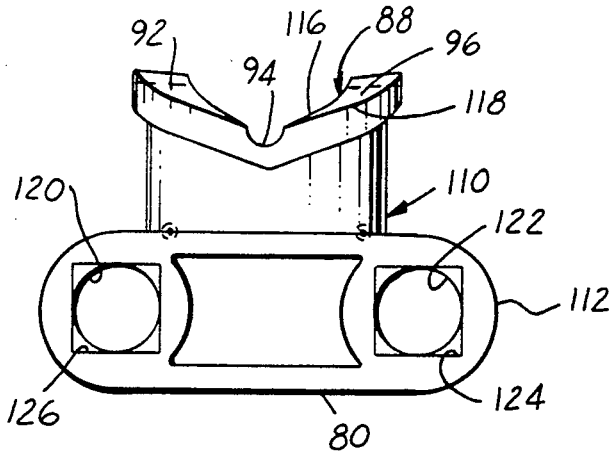
FIG.6
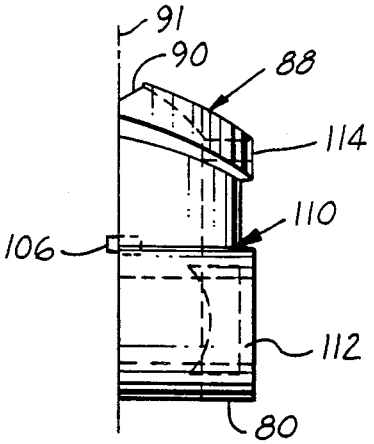
FIG.7
FIG.8
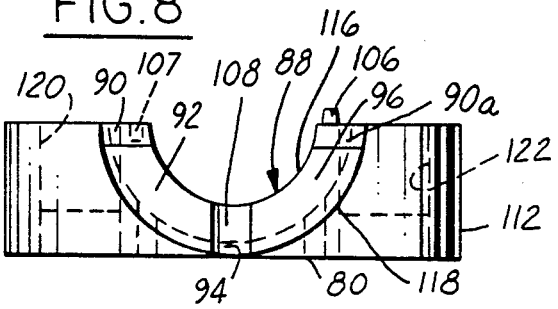

RAIL CAR SHIPPING RACK HAVING YIELDING RACK EXTENSION MEMBERS

BACKGROUND OF THE INVENTION

1. FIELD OF THE INVENTION

This invention relates to a shipping rack convertible to a first rack length for loading onto a semi-trailer and convertible to a second length for loading onto a railroad boxcar.

2. PRIOR ART

Racks of the type, to which the present invention relates, are commonly used for shipping industrial parts. The parts are normally elongated members which do not readily fit into box-like containers. For example, automobile bumpers are elongated and have a curved configuration which does not readily adapt to shipment in box-like containers. The racks used for this purpose normally have a bottom wall and upstanding end walls but no sidewalls. The elements to be shipped can be easily loaded onto the racks with the racks giving vertical and endwise support.

Loaded racks are normally shipped in conventional semi-trailers and railroad boxcars. The semi-trailers referred to are of the type normally pulled by a tractor on highways or, in some cases, shipped for long distances on railroad flat cars.

Both semi-trailers and railroad boxcars have assumed a relatively conventional width. For example, standard railroad boxcars have an interior width of about one hundred ten inches while many semi-trailers have an interior width of about ninety-eight inches. Racks are normally stowed in either railroad boxcars or semi-trailers lengthwise across the width of the railroad boxcar or semi-trailer. There must be a relatively snug fit of the racks across the width of these units so that the racks will not shift within the transporting unit for any appreciable distance while the unit is moving. Such shifting, if it gained momentum by traveling a foot or so within the transporting unit, could cause severe damage to the unit possibly rupturing the sidewalls and/or to the goods carried by the racks. It is, however, desired to have a small clearance between the ends of the racks and the sidewalls of the transporting unit, to facilitate loading and unloading and also to accommodate the small discrepancies in standard width which are encountered in practice. Two inches is normally considered adequate clearance.

In the past, different shipping racks have sometimes been utilized for semi-trailers and for railroad box cars. More recently, advances in the art have allowed the use of one shipping rack in both applications by utilizing pivotal rack extension assemblies. These rack extensions adapt the length of the shipping rack to either the rail car width or the semi-trailer width to allow the shipping rack to be used in either application. An example of such a construction is set forth in U.S. Pat. No. 4,699,280 to Hoss.

While this type of shipping rack has increased the efficiency and convenience of shipping parts by use of these racks, other problems have been incident to the use of these racks. A shipping rack, such as that disclosed in the above U.S. Pat. No. 4,699,280, has rack extension arms which are either locked in the extended position (for use in railroad boxcars) or in the retracted position (for use in semi-trailers). It has become a problem in that during forklift loading or unloading of the shipping racks onto or off of railroad boxcars damage may occur to the extension arms because they are vulnerable in the extended positions. This may be due to the difficulties in controlling forklifts in general or to errant operation of the forklift, but in any case the extensions are often broken or bent requiring repair or replacement of the extension arms, which is costly in both repair costs and down time.

It has therefore been a goal in the art to find a construction which would utilize a shipping rack having rack extensions without being subject to unnecessary repair or down time caused by such inaccurate loading and unloading of the shipping rack.

SUMMARY OF THE INVENTION

The present invention is an improvement for use in a shipping rack convertible to a first rack length for snug lengthwise loading across the interior width of a semi-trailer and convertible to a second rack length for snug loading lengthwise across the interior width of a railroad boxcar. The rack has a bottom wall having a width and length with an upstanding end wall at each end of the length of the bottom wall. The distance between the outside surfaces of the end walls define the first rack length. A pair of spaced apart rack extensions are mounted on one of the end walls. The rack extensions are actuatable to a first position where they are folded into the one end wall to define with the other end wall the first rack length. The rack extensions are actuatable to a second position where they extend outwardly from the outside surface of the one end wall. In the second position the distance between the outer edge surfaces of the rack extension and the outer surface of the other end wall define the second rack length.

According to the present invention, a pivotal support means is provided for pivotally mounting each of the rack extensions to the one end wall. The pivotal support means includes a first means for holding the rack extensions in the first position and for allowing release of the rack extensions to the second position by pivoting of the rack extensions beyond a predetermined position. A second means is provided for releasably centering the rack extensions into the second position and for allowing pivotal movement of the rack extensions and return centering of the rack extensions in response to external forces exerted on the rack extensions above a predetermined level, thereby pivotally yielding to external potentially damaging forces tending to disengage the rack extensions from the second position.

It is an object of the present invention to provide a shipping rack with rack extensions which will yield to potentially damaging forces exerted on the extensions during loading and unloading of a shipping rack.

It is still further an object of the present invention to provide a mounting assembly for a rack extension which is less expensive to manufacture and repair than prior art shipping racks having rack extensions.

Other advantages of the present invention will be readily appreciated as same becomes better understood by reference to the following description when considered in connection with the accompanying drawings.

DESCRIPTION OF THE DRAWINGS

FIG. 6 is a detailed elevational view of the lower hinge portion made in accordance with the teachings of the present invention;

FIG. 7 is a side view of the hinge of FIG. 6; and

FIG. 8 is a top view of the hinge of FIG. 6.

BRIEF DESCRIPTION OF A PREFERRED EMBODIMENT

Figure 1:
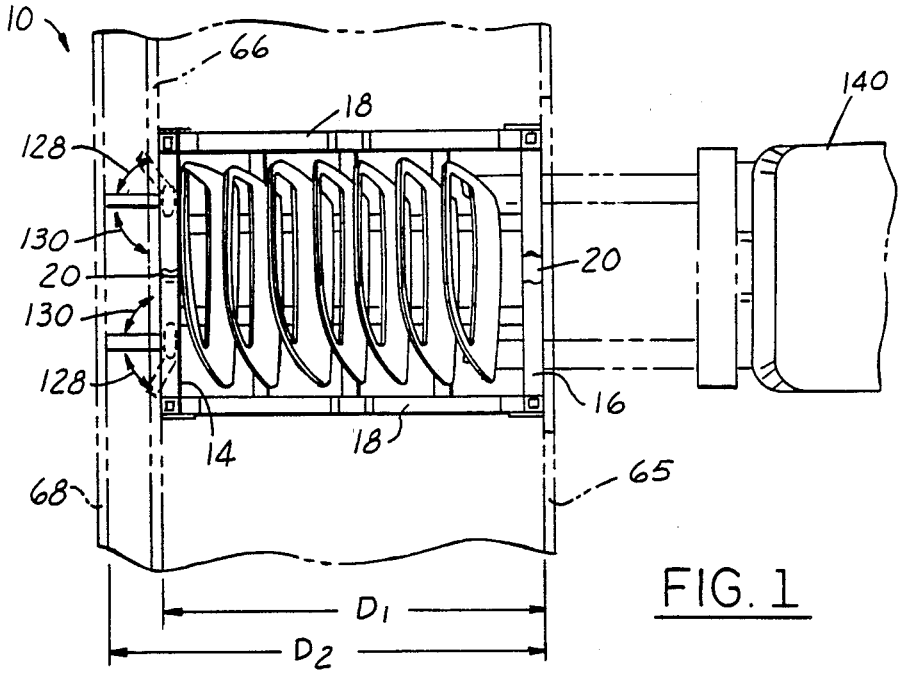
FIG. 1 is a top plan view of a shipping rack made in accordance with the teachings of the present invention and showing the retracted position of the rack extensions in phantom.

Referring to the drawings, it will be noted that the shipping rack 10 includes a bottom wall 12 having a width and a length with an upstanding end wall 14,16 at each end of the length of the bottom wall. The bottom and end walls are fabricated of welded tubular steel. Plastic materials may alternatively be used for fabrication purposes.

The bottom wall 12 comprises a frame consisting of side rail members 18 and end rail members 20. Extending between these members are lateral elements 22 and longitudinal elements 24 which define a grid-like pattern. As will be appreciated, the bottom wall 12 provides vertical support for materials, such as the plurality of vehicle doors shown, which are loaded thereon.

Each of the end walls comprise a frame consisting of upper and lower rails 26,28 and vertical end rails 30,32. Again, these elements may be fabricated of tubular steel and welded together. Feet 34, 36 extend from the lower end of the vertical rails 30,32. One rack 10 may be loaded on another like rack with the feet being received in the hollow upper ends 35,37 of the tubular vertical rails. The end walls are secured to the bottom wall by means of plates 38. The plates are welded at one end 42 to the vertical rails of the end walls. The other ends of the plates are bolted to the bottom wall by means of nut and bolt structures 44 which are secured to projections 46 which are welded to the ends of the bottom wall rails 18. This permits pivoting of the end walls with respect to the bottom wall. As will be seen in FIG. 2, opening means 48 are provided through the plates 38 and projections 46. A pin 50 is received through the opening means 48 and held in place by clevis pin 52 to normally lock the end walls in the upright position shown. When the racks are empty and it is desired to store or return ship them, the pin 50 may be removed and the end walls folded into the bottom wall as shown in dotted lines. Support members 56 are provided on the bottom wall for support of the collapsed end walls. A pair of spaced apart loops 58,60 are provided at each end of the bottom wall to facilitate manipulation of the racks by means of a fork lift truck 140.

A pair of spaced apart rack extensions 62,64 are pivotally mounted on the end wall 14. As will be noted in FIGS. 1 and 2, the rack extensions are pivotable to one position, such as shown by rack extension 64 in FIG. 2, where they are folded into the end wall 14 and pivotable to a second position, such as shown by rack extension 62 in FIG. 2, where they extend outwardly from the outside surface of the end wall 14. Referring to FIG. 1, the distance $D_1$ represents the first rack length which is provided for snug lengthwise loading across the interior width of a semi-trailer, such as shown between phantom walls 65 and 66. The interior width of a standard semi-trailer of the type in which such racks are normally transported is about ninety-eight inches. The rack length $D_1$, which represents the distance between the outside surfaces of the end walls 14,16 is about ninety-six inches. This leaves two inches to spare for loading and unloading of the racks and also takes care of minor discrepancies in the interior width of the semi-trailer.

When the extensions 62,64 are pivoted outwardly as shown in FIG. 1, the distance $D_2$ represents the second rack length. This length is appropriate for snug loading of the racks lengthwise across the interior width of a railroad boxcar, having walls 65 and 68. The interior width of a standard boxcar is about one hundred ten inches. The rack length $D_2$ is about one hundred eight inches. Again, two inches are provided for facilitating loading and unloading and to take care of minor discrepancies in the interior width of boxcars. The distance $D_2$ is measured from the outer surface of the end walls 16 to the outer edge surface of the extensions 62,64 as shown.

Figure 3:
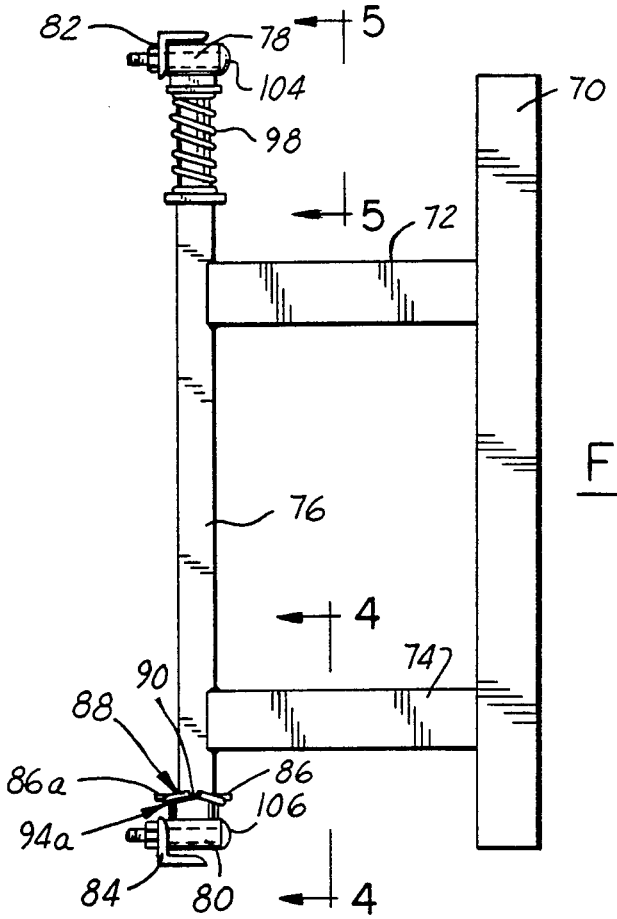
FIG. 3 is a detailed elevational view of a rack extension made in accordance with the teachings of the present invention.
Figure 4:
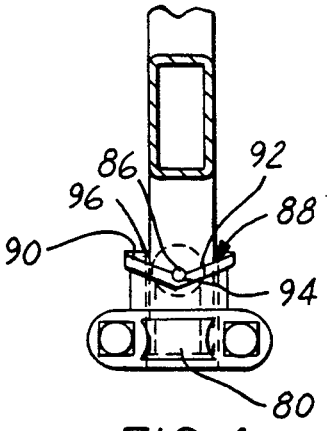
FIG. 4 is a sectional view of the lower pivotal assembly, partially broken away, and taken along line 4—4 of FIG. 3.
Figure 5:
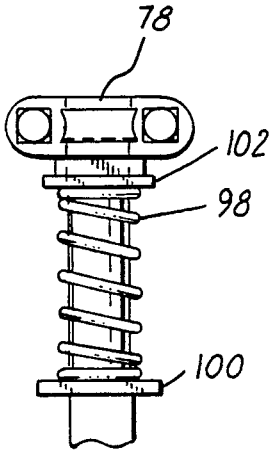
FIG. 5 is a sectional view of the upper pivot assembly taken along line 5—5 of FIG. 3.

The pivotal connection of the rack extensions to the end wall 14 is illustrated in more detail in FIGS. 3, 4 and 5. As thereshown, it will be noted that the extensions comprise a generally rectangular member formed of an outer upright tubular member 70 from which extend tubular cross members 72,74. The members 72,74 are connected to an elongated generally vertically extending hinge rod member 76 which defines the inner edge of the extension. The rod member has a roll pin 86 journaled through its diameter at a lower end thereof.

Figure 2:
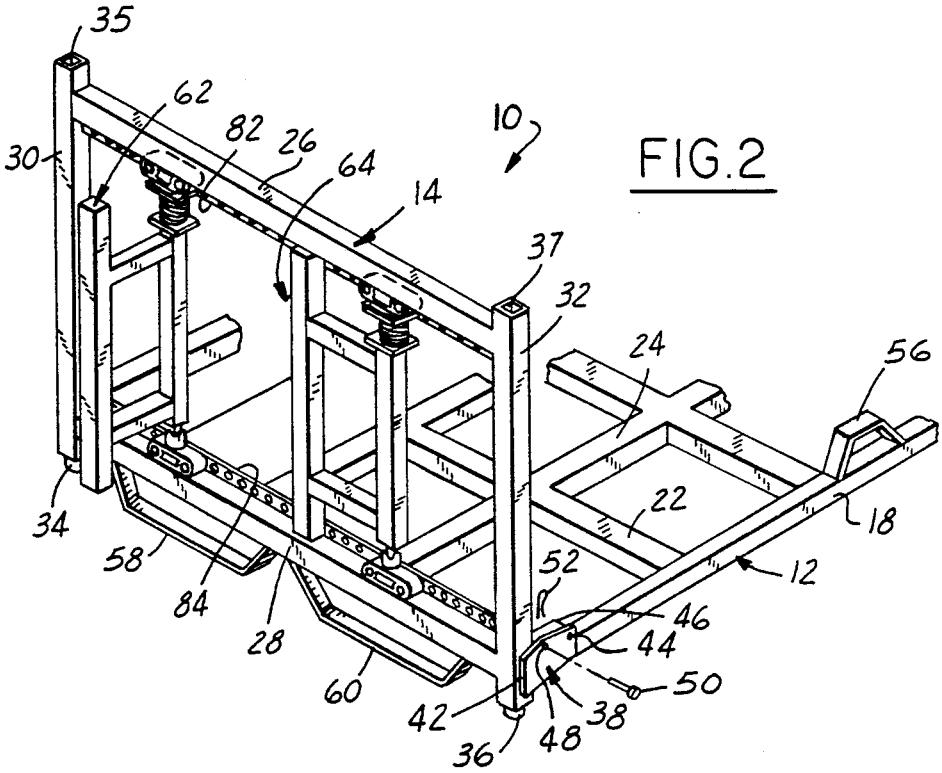
FIG. 2 is a perspective view of the operative end of the shipping rack of FIG. 1.

A pair of spaced apart upper 78 and lower 80 hinge elements are provided which pivotally secure each rack extensions to the upper 26 and lower 28 rails. The hinges are secured to vertically extending upper 82 and lower 84 flanges of angle members which are attached to upper 26 and lower 28 rails. It will be noted that the flanges 82,84 are inset with respect to the thickness of the sidewall tubular frame. The insetting referred to results in the rack extensions folding into the end walls when they are pivoted inwardly as shown in FIGS. 1 and 2 because of the attachment of hinge elements 78 and 80 to the inset flanges 82,84.

The lower hinge 80 includes a bearing surface 88 formed on its uppermost portion. The roll pin 86 rests on bearing surface 88 and is movable along the bearing surface 88.

The lower hinge 80 includes a first indentation 90 on the bearing surface 88 for holding of the roll pin 86 such that the rack extension is removably held in the first position. The roll pin 86 is thus journaled along the same plane as the tubular cross members 72 and 74. Thus, as the hinge rod 76 rotates in the upper and lower hinges the pin rotates in the same plane as the rack extensions.

A downwardly sloped ramp 92 is provided on the bearing surface 88 which leads to a second indentation 94. The hinge rod 76 is vertically supported by roll pin 94 such that when the roll pin 94 is disengaged from the first indentation 90 and upon reaching the upper portion of the sloped surface 92 the weight of the rack extension tends to bias the rack extension 70 into the second position by the roll pin 94 following the ramp downward into the second indentation 94.

A second upwardly extending ramp surface 96 is provided which extends from the second indentation 94 in an upward direction such that the rack extension 70 may pivot in either direction in response to external forces exerted on the rack extension 70 above the predetermined level which will cause roll pin 86 to disengage from indentation 94. Thereafter because ramp surfaces 96 and 92 lead to the indentation 94, the rack extension 70 tends to center itself back into the second indentation 94. The rack extensions of the present invention pivotally yield to external damaging forces tending to disengage the rack extensions from the second position and thereafter allow the rack extension to return to the second position without further manual actuation.

In a preferred embodiment of the present invention, a spring biasing means 98 is provided adjacent the upper hinge 78 which is operably attached to the hinge rod 76. The spring biasing means 98 is preferably a helical spring. The spring is limited in movement by flange 100 attached to the hinge rod and flange 102 which is a part of the upper hinge portion 78, and biases the hinge rod 76 toward movement in a downward direction. Thus, the spring 98 assists in also providing for centering of the rack extension for engagement of the roll pin 86 in the second indentation 94 of the bearing surface by providing further forces on the roll pin to move it downwardly along the ramp surface.

The hinge members 78 and 80 are preferably injection molded of a self lubricating plastic, such as nylon or the like, as are known to those skilled in the art and as such are non-corrosive which increases the operable life of the assembly. Additionally, the hinges are bolted to the flange which provides for easy replacement of the hinges if they are damaged. The hinges are manufactured in two halves which are the mirror image of one another along axis 91 of FIG. 7 except that the halves must have mating locating protrusions 106 and indentations 107. The halves are first assembled to each other and then attached to the flanges 82 and 84 by carriage bolt assemblies 104 and 106.

As illustrated in FIGS. 6, 7 and 8, a representative half portion of the lower hinge 80 is shown.

The hinge portion illustrated in the drawings is one half of the lower outside hinge portion and would include a mirror image hinge portion as its second piece, taken along axis 91, to be assembled and attached to the shipping rack through the carriage bolt assemblies as discussed above. The hinge 80 includes first and second ramp surfaces 92 and 96 as is discussed above with indentations 90 and 94 therein. In a preferred embodiment, the second mirror image portion of the hinge would mate with this hinge by way of providing a suitable locating indentation and positioning protrusion in the second hinge portion for mating with positioning protrusion 106 and locating indentation 107 such that indentations 90 would be formed on a first end thereof.

A second indentation **90*a* is also provided in the preferred embodiment for engaging the other end 86*a* of the roll pin and is likewise formed when the mirror image half of the hinge is connected with the hinge portion shown. Additionally, as shown in FIG. 3, the hinge also includes a pair of second indentations 94 and 94*a* for engaging the roll pin in the present invention when the rack extensions are pivoted to their second position. Additionally, the second hinge portion provides a second set of ramps corresponding to the ramps 92 and 96 which act in combination with ramps 92 and 96** to center the rack extensions.

The lower hinge 80 includes a cylindrical portion with surfaces 108 for forming a bore which along with the mating half of the hinge pivotally engages the lower end of the hinge rod 76. The cylindrical portion includes a lower portion 110 connected to the hinge connecting flange 112. The hinge flange 112 also include a pair of bores 120 and 122 which have square carriage bolt indentations 124 and 126 for allowing carriage bolts to be inserted therethrough and be bolted on the other side for securing the hinge to the flange 84.

The upper surface of the cylindrical hinge bore portion defines the bearing surface 118 and includes an extending rib portion 114. The bearing surface defining each of the ramps 92 and 96 includes a radially inner edge 116 and a radially outer edge 118. The radially inner edge 116 is axially lower along the ramp surface than the radially outer edge 118 such that the roll pin engages and rides along the outer edge 118. A downward slope in the radially inward direction, as shown in the figures, is provided. This provides a reduced frictional engagement with the roll pin 86 while moving along the bearing surface 88. Additionally, this provides a wear surface without breaking down of the bearing surface, due to the fact that as the radially outer edge 118 of the ramp tends to wear into the hinge portion, a ramp surface will still be provided because of the radially inward slope of the ramp surface to inner edge 116.

The upper hinge 78 is similar to the lower hinge in that it has a central bore which pivotally engages the hinge rod 76, is also produced in mating halves and has suitable bores for attaching the hinge to upper flange 82 by way of carriage bolt assemblies. The upper hinge 78 includes a stop flange 102 for limiting movement of the helical spring in an upward direction. The hinge rod is pivotal in the hinges and also is allowed vertical movement limited in the upward direction by the compression of spring 98 and limited in the downward direction by engagement of the bearing surface 88 by roll pin 86.

Because of the weight of the rack extensions and the tendency of the spring to bias the hinge rods of the rack extensions in a downward direction, the rack extensions are securely held in the first position by the roll pin engaging the indentations 90 and **90*a* until it is desired that they be extended to the second outwardly extending position. In order to accomplish outwardly extending the rack extensions, the rack extensions are freely movable by a predetermined horizontal rotational force in the direction to disengage the roll pin from indentations 90 and 90*a* whereafter the ramp surfaces 92 and 96 tend to automatically direct and center the rack extensions into the second indentations 94 and 94*a* wherein the rack extensions are therein securely held until sideward pivotal forces are imposed on the rack extensions such as by errant operation of a forklift 140 or the like which in the past tended to damage these rack extensions. However, in the present invention, if such a force is encountered, the rack extensions may pivot in either direction as shown by arrows 128 and 130 in FIG. 1 to yield to these forces and thereafter when the force has been relieved, the extensions will again return to the second position as shown in solid lines in FIG. 1 as a result of the interaction between pin 86 and ramp surfaces 90,92**.

While the above description constitutes the preferred embodiment of the present invention, it is to be appreciated that the invention is susceptible to modification, variation and change without departing from the proper scope and fair meaning of the accompanying claims.

I claim:

1. In a shipping rack convertible to a first rack length for snug lengthwise loading across the interior width of a semi-trailer and convertible to a second rack length for snug loading lengthwise across the interior width of a railroad boxcar, the rack comprising a bottom wall having a width and a length, an upstanding end wall at each end of the length of the bottom wall, the distance between the outside surfaces of the end walls defining said first rack length, a pair of spaced apart rack extensions mounted on one of the end walls, said rack extensions being actuatable to a first position where they are folded into said one end wall to define with said other end wall the first rack length and being actuatable to a second position where they extend outwardly from the outside surface of said one end wall in which position the distance between the outer edge surfaces of the rack extensions and the outer surface of the other end wall define the second rack length, the improvement comprising:

a pivotal support means for pivotally mounting each of said rack extensions to said one end wall;

said pivotal support means further comprising a first means for holding the rack extensions in said first position and for allowing release of said rack extensions to said second position by pivoting of said rack extensions beyond a predetermined position;

a second means for yieldably centering said rack extensions into said second position and for allowing pivotal movement of said rack extensions and return centering of said rack extensions in response to external forces exerted on said rack extensions above a predetermined level whereby said rack extensions may pivotably yield to external lateral potentially damaging forces and thereafter return to the second position;

a second upwardly extending ramp surface leading from said second indentation in an upward direction wherein said rack extension may pivot in either direction when in said second position and said first and second ramps will provide biasing toward centering of said rack into said second position;

said pivotal support means comprising a pair of upper and lower hinges for pivotally attaching each of said rack extensions to said one end of said rack, said lower hinge including an upper bearing surface;

said rack extensions each including a vertical hinge rod having an upper and lower end pivotally mounted in one pair of said upper and lower hinges respectively;

a roll pin journaled through the diameter of each hinge rod at said lower end of said hinge rod, said roll pins each downwardly resting on and movable along the upper bearing surface of the respective lower hinge;

said first means further comprising a first indentation in said bearing surface for holding of said roll pin such that said rack extension is in said first position, said pin being disengagable from said first indentation by pivotal actuation of said rack extension; and said second means further comprising a downwardly sloped ramp surface in said bearing surface leading to a second indentation for biasing said extension rack into said second position by said roll pin following said ramp downward into said second indentation;

each lower hinge including a cylindrical portion having surfaces defining a bore pivotally engaging the lower end of a hinge rod, each cylindrical hinge bore portion including a lower portion connected to a hinge flange for attaching said hinge to said one of said end walls and an upper surface for defining said bearing surface, said upper surface including a radially inner edge and a radially outer edge, said downwardly sloped ramp further comprising a downward slope in the radially inward direction defined by said radially outer edge being axially higher than said radially inner edge along a common radius of said cylindrical portion whereby the roll pins engage and ride along the radially outer edge to result in reduced frictional engagement.

2. The shipping rack according to claim 1 further comprising a spring biasing means operatively attached to said hinge rod, said spring biasing means biasing said rod toward movement in a downward direction for assisting movement of said roll pin along either of said first or second ramps toward said second position when said rack is pivoted out of said second position.

3. The shipping rack according to claim 2 wherein said spring biasing means is adjacent said upper hinge portion of said rack extensions and is engaged in compression between a flange attached to said hinge rod and a flange of said upper hinge.

* * * * *